US005397150A

United States Patent [19]

Commier et al.

[11] Patent Number: 5,397,150

[45] Date of Patent: Mar. 14, 1995

[54] RIBBED SKI PROVIDED WITH A SUPPORT

[75] Inventors: Philippe Commier, Annecy; Jacques Le Masson, Cran Gevrier, both of France

[73] Assignee: Salomon S.A., Metz-Tessy, France

[21] Appl. No.: 83,466

[22] Filed: Jun. 30, 1993

[30] Foreign Application Priority Data

Jul. 9, 1992 [FR] France ..... 92 08678

[51] Int. Cl.[6] ..... A63C 5/00

[52] U.S. Cl. ..... 280/607; 280/609; 280/617

[58] Field of Search ..... 280/607, 617, 618, 601, 280/609

[56] References Cited

U.S. PATENT DOCUMENTS 5,125,680 6/1992 Bejean et al. ..... 280/607 X

FOREIGN PATENT DOCUMENTS 0465794 1/1992 European Pat. Off. ..... A63C 5/04
0490043 6/1992 European Pat. Off. ..... A63C 5/07
2670393 6/1992 France ..... A63C 5/03
2675390 10/1992 France ..... A63C 5/06

*Primary Examiner*—Margaret A. Focarino
*Assistant Examiner*—Michael Mar
*Attorney, Agent, or Firm*—Sandler, Greenblum & Bernstein

[57] ABSTRACT

A ski, especially alpine, including a lower sliding surface joined at two lateral surfaces themselves joined at an upper surface which has a median rib extending longitudinally, at least in the central zone of the ski. The rib is raised with respect to two lateral lowered portions bordering it from each side and on which a support takes support, adapted to receive the bindings. The support has the shape of an inverted "U" and includes an upper wall extending laterally and downwardly by two lateral walls to constitute a lower housing adapted to the passage of rib. The lateral walls of support include at least one recess which extends horizontally. The recesses become deformed in case of overpressure on the support caused during skiing and the support plays the role of a suspension.

29 Claims, 6 Drawing Sheets

6
D
D
C
C
102
130b
L
11
11b
13
11a
10
h
130a
L1
7
9
B
B
1
4
A
A
5

6
D
D
C
C
8
9
101
102
11b
100
INT
I
I'
10
11a
L2
B
B
7
3
2
4
A
A
5

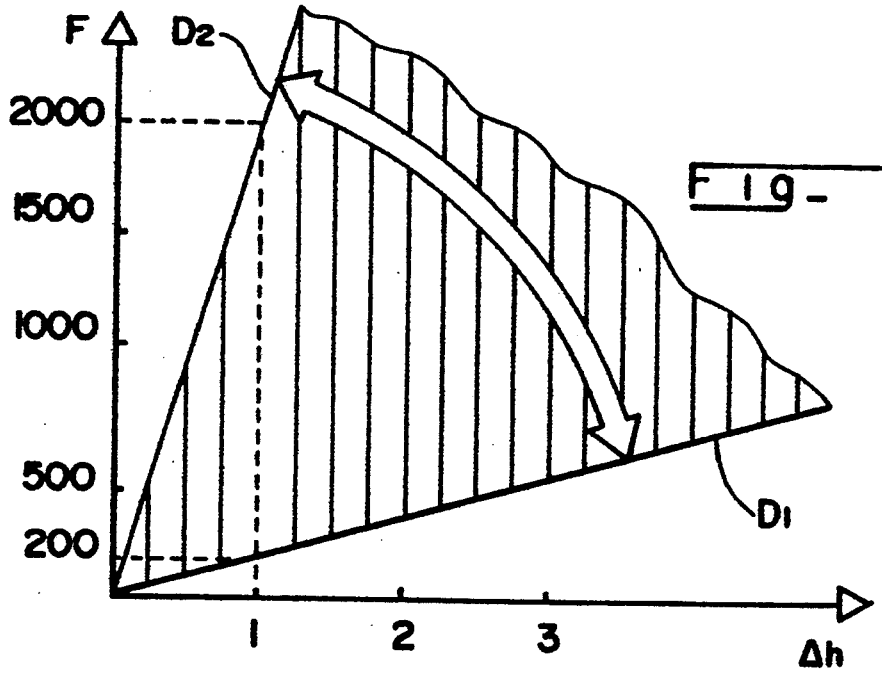
Fig- 4a
Fig- 5
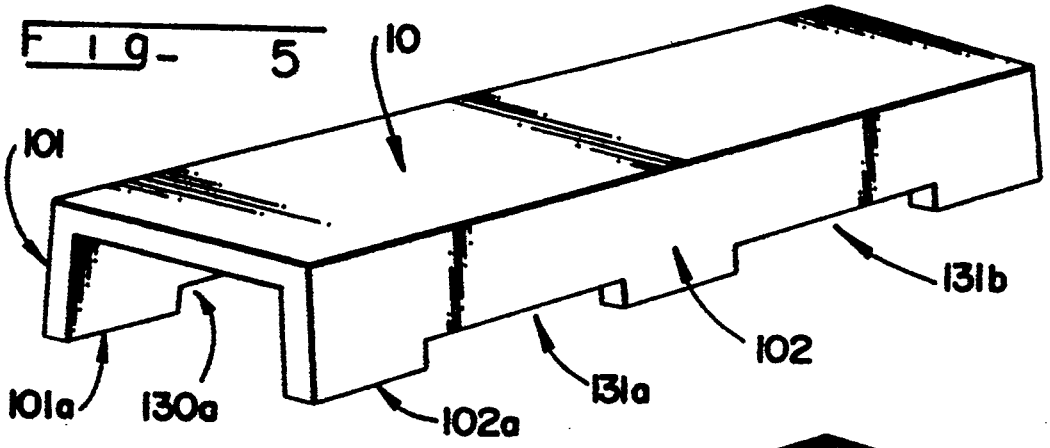
Fig- 6
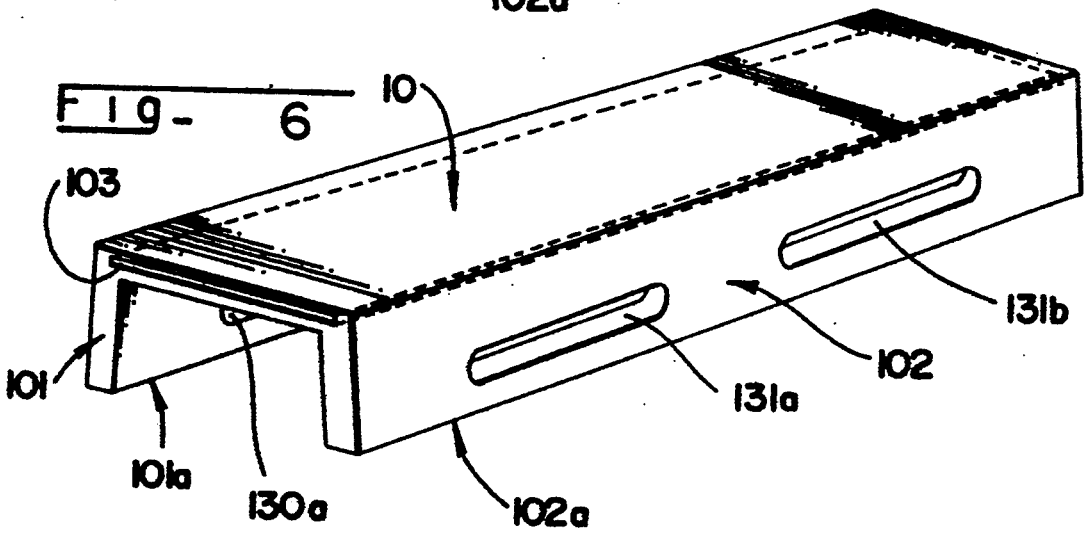

RIBBED SKI PROVIDED WITH A SUPPORT

BACKGROUND OF THE INVENTION

1. Field of the Invention

The present invention is related to a ski, especially an alpine ski, a monoski or a snowboard. It is particularly related to an improvement in this type of ski.

2. Discussion of Background and Relevant Information

Skis that are in general use comprise a lower sliding surface that connects two lateral surfaces along two lower edges provided with metallic running edges, the lateral surfaces connecting an upper surface. The skis have a relatively small width with respect to their length, their front end being curved upwardly to form a spatula. The thickness of the ski is generally greater in the central portion than in the front and rear portions of the ski. In the most commonly used classic shapes, the width of the lower surface of the ski is smaller in the central portion than in the rear and front portions, the width being maximum at the front portion of the ski, i.e., in the vicinity of the spatula.

In known ski structures, the upper surface of the ski is generally a regulated surface, i.e., defined by the longitudinal displacement of a transverse straight line parallel to the lower surface of the ski. In other words, the transverse section of the ski is generally a rectangle or a trapezium, the larger opposing sides of the rectangle or of the trapezium being formed by the lower surface and the upper surface of the ski, the smaller opposing sides of the rectangle or of the trapezium being formed by the lateral surfaces of the ski.

The greater thickness of the ski in the central zone confers a greater rigidity to the central zone. Such central zone is also adapted to receive the bindings for the adaptation of a boot of the user. On the other hand, the front and rear zones of the ski, which have a reduced thickness, are more flexible and become deformed elastically during use of the ski. If one wishes to obtain a ski with a good flexibility in the front and rear zones, it becomes necessary to provide such front and rear zones with reduced thicknesses.

A first problem encountered in traditional ski structures is that the central zone of the ski, which has a relatively substantial thickness in order to provide it with greater rigidity, causes a fairly substantial spacing of the bindings with respect to the lower edges of the ski. The lower edges are elements which are adapted to bite into the ice, while taking a turn. The efficiency of the lower edges provided with running edges is that much better when the connection between the foot of the user and the running edge is more direct. The spacing between the running edge and the binding tends to decrease the efficiency of the running edges. To overcome this disadvantage, European Patent Application No. 465,794 describes a ski structure having, especially on its upper surface, a median rib extending longitudinally on either side of the central zone and lowered lateral recesses bordering each side of such rib and on which a support or a stirrup in the shape of an inverted "U" takes support, the element adapted to receive the bindings.

A second problem encountered in current ski structures is that in some configurations, especially when the skier is leaning forward while entering a curve or, conversely, leaning backward, while leaving a curve, the portion across from the support becomes lighter and loses contact with the snow. To respond to this problem, French Patent Application Nos. 9,016,048, 9,105,012 and 9,204,190, for example, suggest replacing the median rib by an attached element, made of one or two portions constituting a stiffener, partially linked to a base and which extends longitudinally, at least in the central zone of the ski and advantageously beyond it, i.e., along a length comprised between approximately 50 and 80 percent of the length of the base in contact with the snow. The stiffener enables a balanced distribution of pressures of the ski in movement to be obtained and also enables the above-cited disadvantages of traditional skis to be avoided, whatever the configuration of the skier. Thus, the ski gains in stability and according to the adjustment of the stiffener and/or its design, the stability/maneuverability ratio can be improved.

SUMMARY OF THE INVENTION

The present invention is an improvement to these types of skis. As it has been explained, such new shapes and structures enable an increase in the transmission of forces from the skier on the running edges by virtue of a more direct connection between the foot and the running edge. This transmission can have a disadvantage when the ski, driven on the running edge at high speeds, is subject to a temporary overpressure such as due to encountering a hard piece of ice, for example. This can cause a "disengagement" phenomenon which is translated by an involuntary lateral sliding of the ski from the side of the slope, causing a deviation in the path.

An object of the present invention is to resolve this disadvantage by reducing the maximum overpressure points which can be assimilated into a general vibratory phenomenon. The behavior of the ski is improved by the fact that the extreme amplitudes are smoothened and the ski maintains a directional stability whatever the surface state of the ground over which it moves.

To attain these goals as well as others, the ski in accordance with the present invention is such that it comprises a lower sliding surface joining at two lateral surfaces along two lower edges, the lateral surfaces joining at an upper surface, the upper surface comprises a median rib extending longitudinally, at least in the central zone of the ski and which is raised with respect to the two lateral lowered portions bordering it from each side and on which a support adapted to receive the bindings takes support, the support has the shape of an inverted "U" which comprises an upper wall extended laterally and downwardly by two lateral walls to constitute a lower housing adapted to the passage of the rib, at least one of the lateral walls of the support comprises at least one recess extending horizontally.

Thus the support can become deformed in case of overpressure, by a reduction in the space of the recess and especially of its height. The support plays the role of a suspension enabling the "disengagement" phenomenon to be avoided.

It can be provided that the lateral wall of the support located on the inner side of the ski, particularly biased when the running edges get a grip, be crossed by a front recess close to the front abutment of the binding and a rear recess close to the heel attachment of the binding spaced from one another. Thus, the front recess is mainly biased during front support of the skier exerted while entering a turn and the rear recess is mainly biased while leaving a turn.

Advantageously, each lateral wall of the support is crossed by a front recess and a rear recess spaced from one another.

According to a complementary characteristic, the length of each recess is comprised between 50 and 150 millimeters and its height is comprised between 0.5 and 6 millimeters.

According to another characteristic, the recess is formed by a cut-out obtained on the lower edge of the lateral wall of the support so as to constitute a slot when the support is in support on the lateral lowered portions of the ski.

According to a variation, the recess is formed by a slit obtained in the lateral wall itself of the support, at a distance from the lower edge of the lateral wall of the support.

BRIEF DESCRIPTION OF THE DRAWINGS

Other objects, characteristics and advantages of the present invention will become clearer upon reading the description of the preferred embodiments that follow, described with reference to the annexed drawings in which:

FIG. 5 is a perspective view of the support adapted to the ski as per the invention;

FIG. 6 is a variation of FIG. 5;

DETAILED DESCRIPTION OF THE PREFERRED EMBODIMENTS

Figure 1:
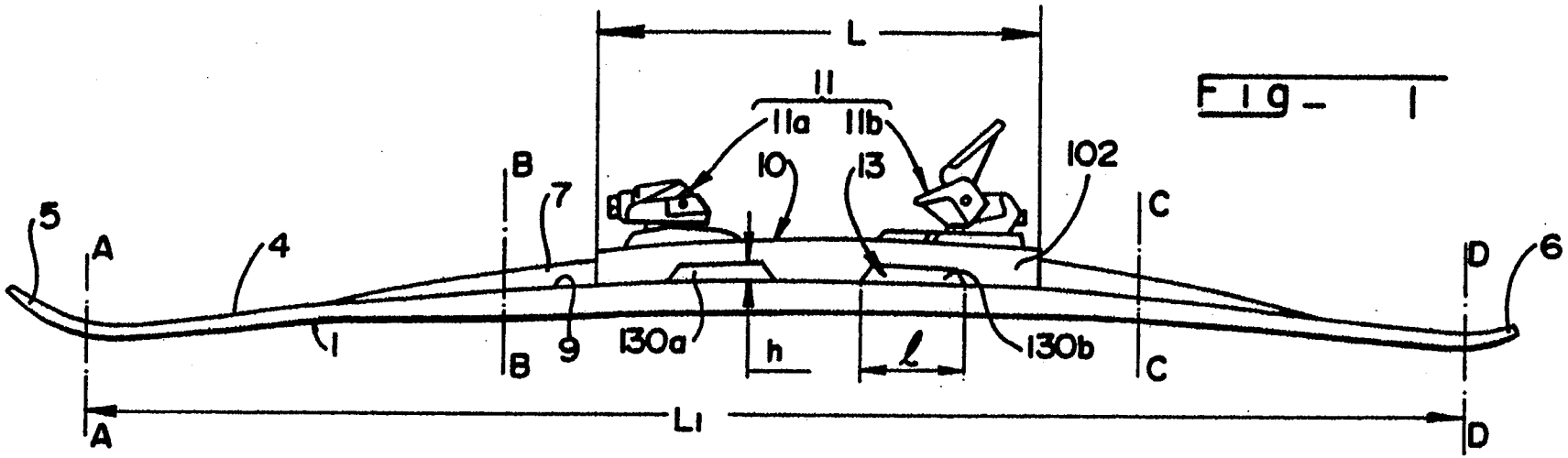
FIG. 1 is a schematic view of a sectional view of the ski as per the invention.
Figure 2:
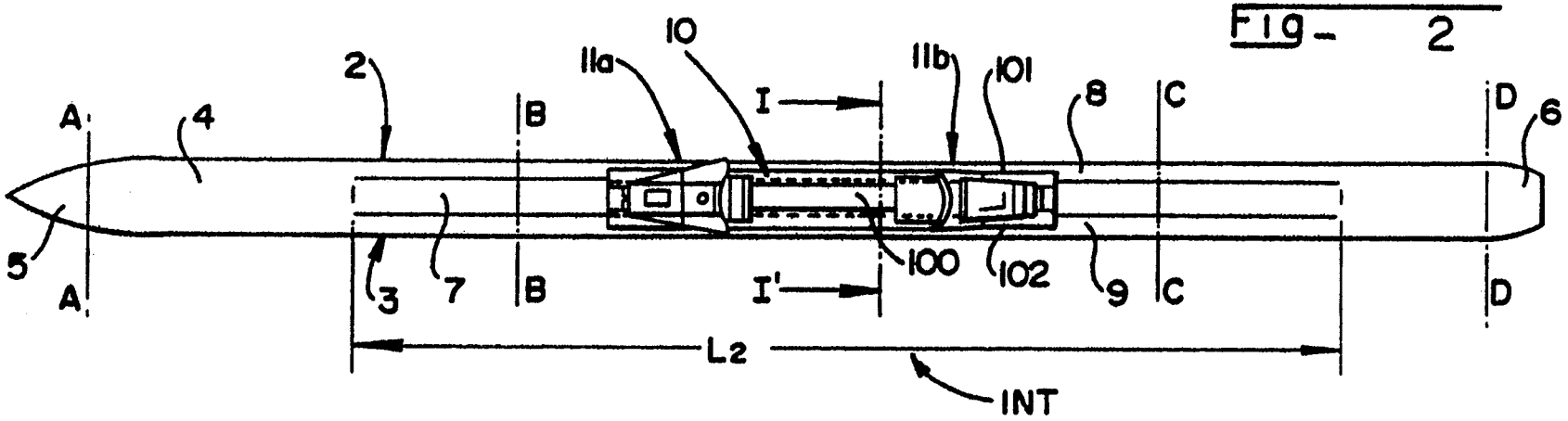
FIG. 2 is a schematic view of the top of the ski of FIG. 1.
Figures 3, 4:
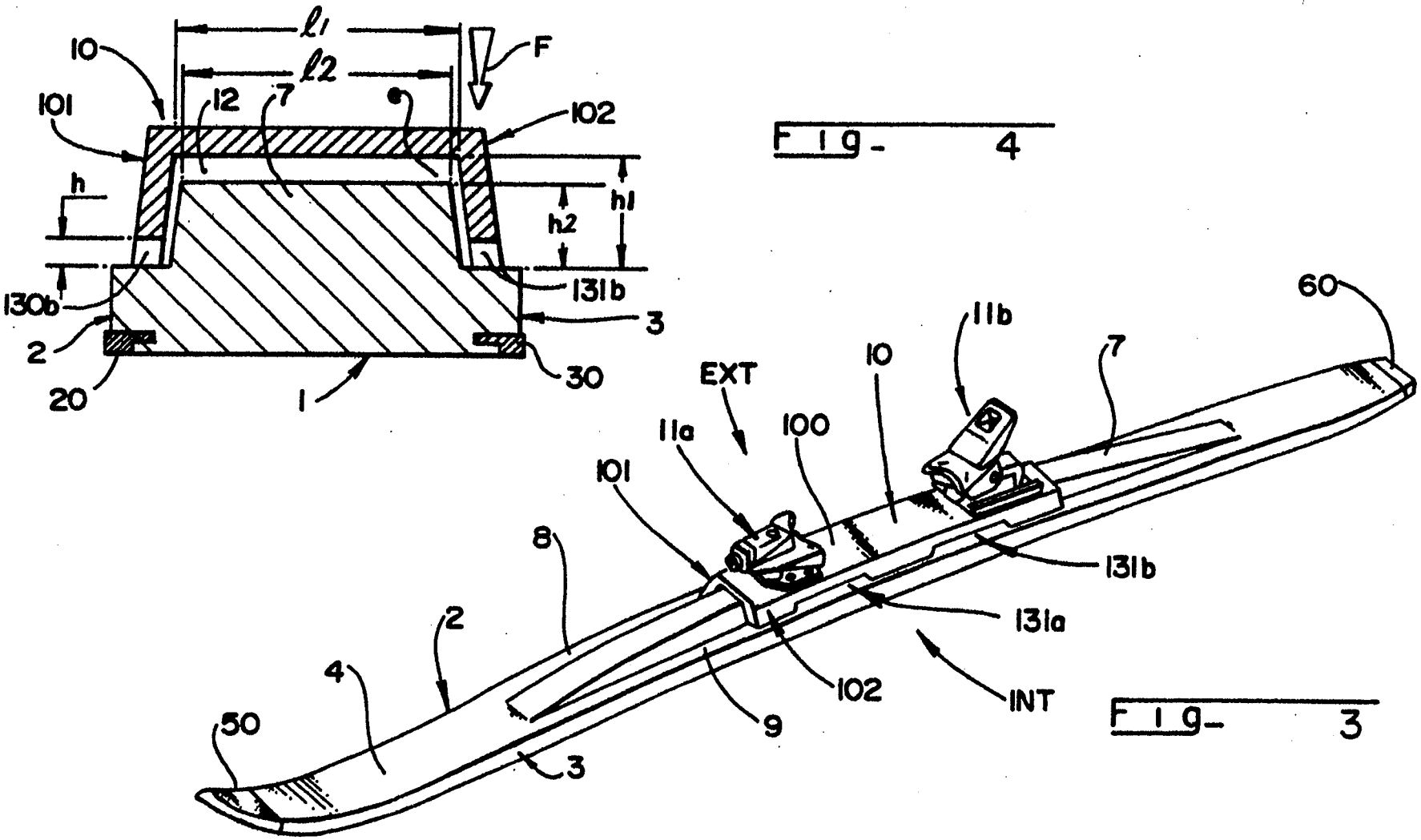
FIG. 3 is a perspective view of the ski as per the invention.
FIG. 4 is a sectional view along (I–I') of FIG. 2.

As is represented in FIGS. 1–4, the ski comprises a lower sliding surface (1) joined at two lateral surfaces (2, 3) along two respective lower edges (20, 30) provided with metallic running edges. The lateral surfaces (2, 3) join at an upper surface (4). The front end of the ski is curved upwardly to form a spatula (5) between section line (A—A) and the front end of the ski. The rear end of the ski is slightly curved upwardly to form the heel (6) between section line (D—D) and the rear end of the ski. Lines (A—A) and (D—D) respectively correspond to the line of front contact and the line of rear contact of the ski. The ski can especially comprise a spatula cap (50) and a heel protector (60), fixed by any means such as a snap-fit, i.e., a friction fit, or by adhesion, for example (as represented in FIG. 3 more specifically).

The upper surface comprises a median rib (7) extending longitudinally in the central zone of the ski. The central zone of the upper surface of the ski is considered to be constituted by that portion of the ski located between the $\frac{1}{3}$ and $\frac{2}{3}$ centered at the middle of the ski between the zones of in the between section lines (B—B) and (C—C) represented in FIGS. 1 and 2. In this zone, at least the median rib (7) is raised with respect to the two lowered lateral portions (8, 9) bordering it from each side.

The median rib (7) constitutes a thicker portion of the ski, i.e., the distance between the upper surface of the median rib (7) and the lower surface (1) of the ski is accentuated, to confer to the central zone of the ski, an appropriate mechanical rigidity. The length ($L_2$) of the rib is comprised, preferably, between 50 and 100 percent of the length ($L_1$) of the lower sliding surface (1) entering into contact with the snow, i.e., between lines (A—A) and (D—D).

A support (10) of length (L) less than ($L_2$) and having the shape of an inverted "U," adapted to receive the bindings (11) takes support on each lateral lowered portion (8, 9). It is linked to these portions by any means such as adhesive, screws or welding. It comprises an upper wall (100) on which the bindings (11) are secured, such as by screws and extends laterally and downwardly by two lateral walls (101, 102) to constitute a housing (12) adapted to the passage of the median rib (7). Thus, it must be noted that the dimensions of the housing (12), both horizontal ($l_1$) as well as vertical ($h_1$) are greater than the respective horizontal ($l_2$) and vertical ($h_2$) dimensions of the rib to form a space "e".

According to the invention, the lateral wall (102) of the support (10) located on the inner side of the ski (INT) comprises at least one recess (13), preferably two recesses (13*aa*, 13*ab*) spaced from one another. In this specific case, the front recess (13*aa*) is located in the vicinity and beneath the front abutment (11*a*) of the binding (11) and the rear recess (130*b*) is located in the vicinity and beneath the heel attachment (11*b*) of the binding. Each recess extends horizontally in such a way that its length (1) is greater than its height (h). The length (l) of each recess is comprised between 15 and 150 millimeters. The length (l) is comprised between 0.02 and 0.75 L when the lateral wall only comprises a single recess. Generally, length (l) is comprised between (0.02/n) and (0.75/n) L when the wall comprises n recesses.

As can be seen in FIG. 4, each lateral wall (101, 102) can be crossed by one or several recesses (130*b*, 131*b*) thus enabling the interchangeability of the right and left skis. For example, each lateral wall (101, 102) of the support can be provided with two recesses (130*a*, 130*b*, 131*a*, 131*b*) spaced from one another. One can also ensure that each recess has a different shape and/or length.

FIG. 4*a* represents force F applied on the support vertically to the center of the recess in accordance with the variation of the height of the recess (or clearance). Each recess envisioned by the invention is defined by its curve $F=f(\Delta h)$ which is comprised within a functional cone limited by a minimum limit $D_1$ and a maximum limit $D_2$. $D_1$ corresponds to a slope equal to 200N/mm and $D_2$ to a slope equal to 2000N/mm. Different parameters enable curve $F=f(\Delta h)$ to be varied for each recess, such parameters being, mainly, the shape of the recess, its length, the thickness of the lateral walls (101, 102) of the support, the rigidity of the material of the support, etc.

FIGS. 5 and 6 show two different ways of envisioning the recesses. Each recess of the support (10) of FIG. 5 is formed by an open undercut or depression obtained on the lower edge (101*a*, 102*a*) of the lateral wall (101, 102) whose depth is equal to the height of the recess to be obtained. The recess thus constitutes a slot when the support is in support on the lateral lowered portions of the ski. In FIG. 6, each recess (130*a*, 130*b*, 131*a*, 131*b*) is constituted by a slit obtained in the lateral wall itself of the support and located at a certain distance from the lower edge (101*a*, 102*a*) of the lateral wall (101, 102).

The support is made of a plastic or composite material susceptible to a certain amount of deformation. It is obtained in a single piece, preferably, by molding. It can be provided that the upper wall of the support comprises an insert (103) which is metallic or fiber based, preferably of glass and of resin, preferably phenolic, enabling the bindings to be screwed therein as is shown in FIG. 6. The insert can be embedded in the plastic material during molding of the support element.

Figure 7:
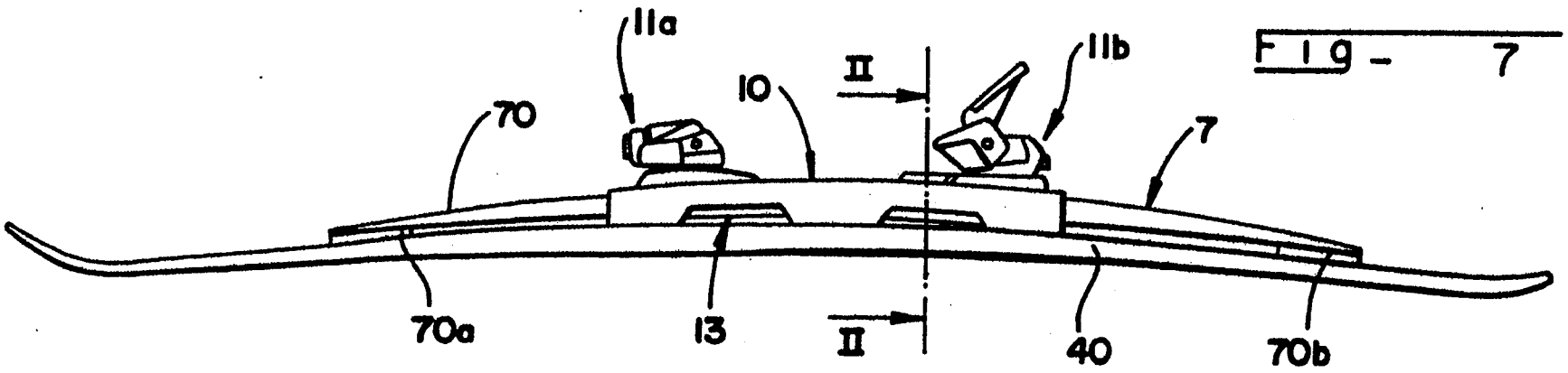
FIG. 7 is a variation of FIG. 1.
Figure 8:
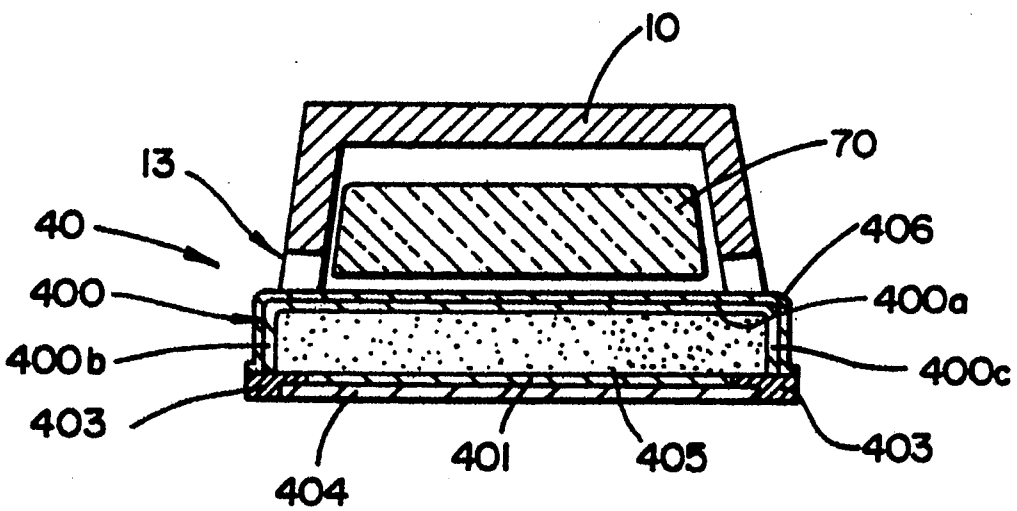
FIG. 8 is a sectional view along (II–II') of FIG. 7.

FIGS. 7 and 8 show a variation in which the ski comprises a first lower assembly or base (40) and a second upper assembly or stiffener (70) adapted to complement the distribution of stiffness of the base. The stiffener constitutes the median rib (7) in the central zone and is raised with respect to the lateral portions (8, 9) of the base. The stiffener is partially linked by each of its ends to the base by rigid or flexible connection means (70*a*, 70*b*). The flexible connection means can be constituted by an interface made of a flexible elastomer or plastic material, for example.

The structure of the base (40) can be of the sandwich type or of the box (i.e., cap type or of any other type. In FIG. 8, a preferred structure has been represented, comprising an upper, rigid reinforcement (400) shaped like a shell having a "U" section forming an upper wall (400*a*) and two lateral walls (400*b*, 400*c*) covering a core (401), the assembly being closed at its lower portion by a lower element (402) comprising the metallic running edges (403), a sliding layer (404) generally made of polyethylene as well as lower reinforcement elements (405). An upper superficial protection and decorative layer (406) covers the upper reinforcement to form the decor of the base.

The reinforcement layers (400, 405) can be of any type such as layers of composite material such as fiberglass, carbon fiber with epoxy and/or polyester resin. They can also be made of metal, metal alloys or fiber metal.

The core (401) can be of foam, reinforced or not, with wood or an aluminum honeycomb.

The single-layered or multi-layered superficial layer ensuring the decor can be made of polyamide, or other, such as a thermoplastic material.

The structure of the stiffener can be of the box type having a variable section along the ski, and be formed by a core located between an upper reinforcement and a lower reinforcement (not represented). It can also be constituted by a simple reinforced profile having a longitudinally evolving section obtained by the TRE, SMC technique.

Figure 9:
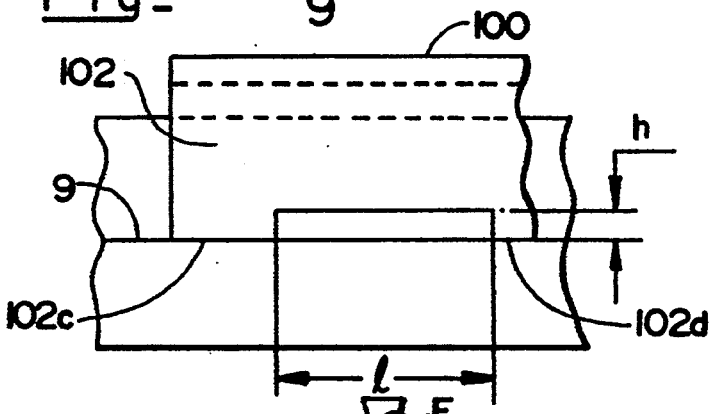
FIGS. 9 and 10 are simplified and partial views of the ski as per the invention showing a special shape of the recess.
Figure 10:
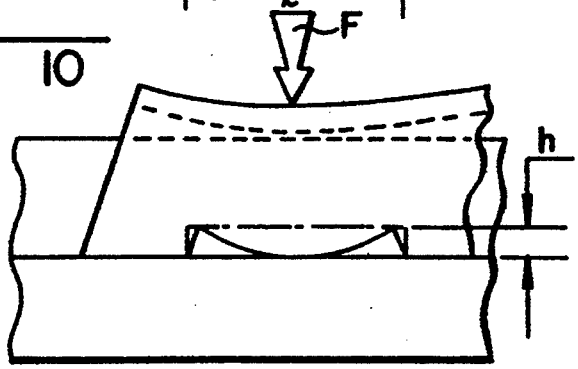
Figure 10A:
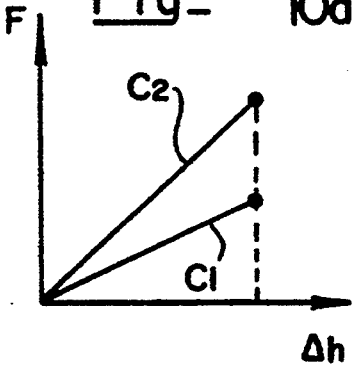
FIG. 10*a* illustrates the variation curve of the arrow in accordance with the force applied on the recess, as per the variations of FIGS. 9 and 10.

FIGS. 9 and 10 show an example of the shape of a recess in one of the walls (102, e.g.) whose height (h) is constant. The application of a force (F) on an intermediate portion of the upper wall (100) of the support causes its deformation and the proportionate decrease in height (h) of the recess creating a suspension effect. During such deformation, at least portions of the forward and rearward lower edges (102*c*, 102*d*) of the wall (102) remain in contact with the lower or lateral portion (9) of the upper portion of the ski. FIG. 10*a* represents two examples of curves (C1, C2) for recesses having the general shape of FIGS. 9 and 10, i.e., having a constant height. In comparison, the two curves ($C_1$, $C_2$) are linear but the slope of $C_1$ is less than that of $C_2$ because the length of the recess of $C_1$ is less than the length of the recess of $C_2$ (all other parameters being equivalent).

Figure 11:
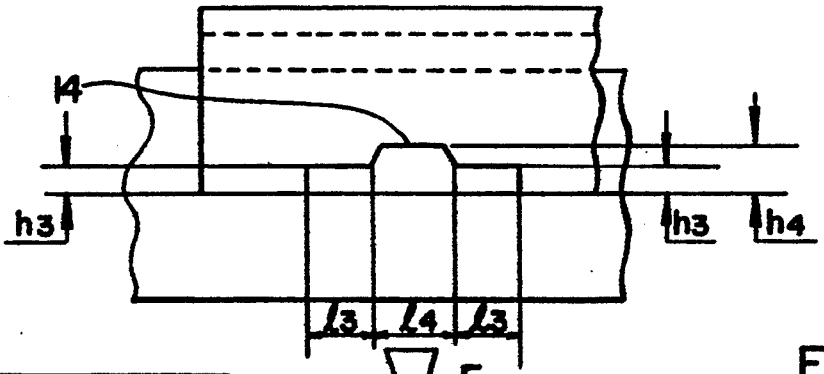
FIGS. 11 and 12 are variations of FIGS. 9 and 10.
Figure 12:
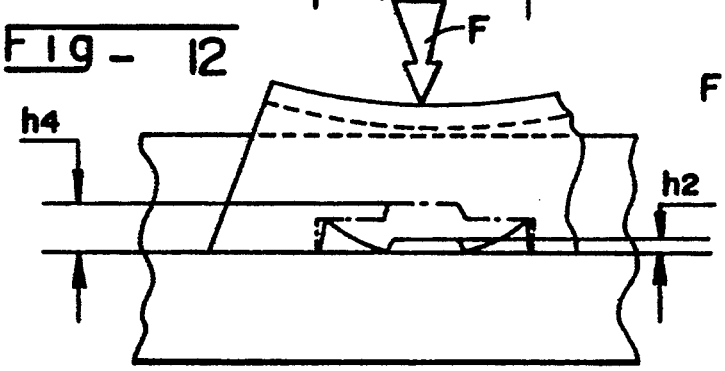
Figure 12A:
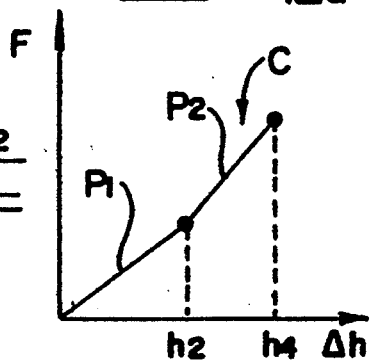
FIG. 12*a* illustrates the variation curve of the arrow in accordance with the force applied on the recess, as per the variations of FIGS. 11 and 12.

FIGS. 11–12*a* show another example of the shape of the recess whose height is variable and which comprises an upper edge (14) in steps. In the present case, the recess comprises a central portion having a length ($l_4$) and height ($h_4$) located between two lateral portions of length ($l_3$) and height ($h_3$); with ($h_4$) greater than ($h_3$). FIG. 12*a* illustrates the variation curve (C) of $\Delta h$ in accordance with the force (F) applied at the center of the recess. This curve is divided into two portions $P_1$ and $P_2$. $P_1$ corresponds to the deformation of the recess until $\Delta h = h_2$ and $P_2$, whose slope is greater than that of $P_1$, corresponds to the deformation of the central portion of length $l_4$ until $\Delta h = h_4$.

Figure 13:
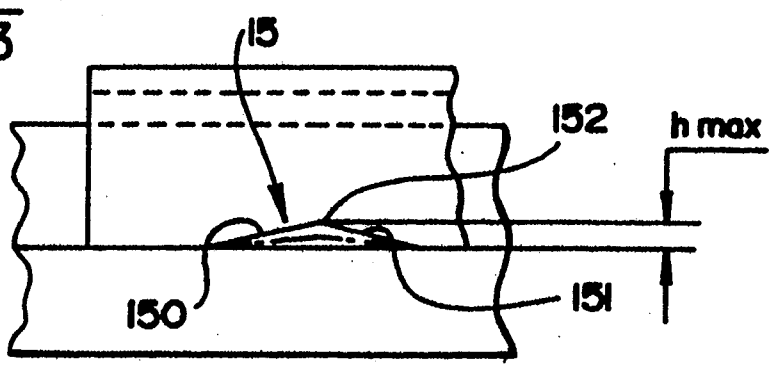
FIG. 13 is another variation of the shape of the recess.

FIG. 13 illustrates a recess shaped like a triangle whose upper edge (15) comprises a first increasing rectilinear portion (150) joined to a second decreasing rectilinear portion (151).

Figure 14:
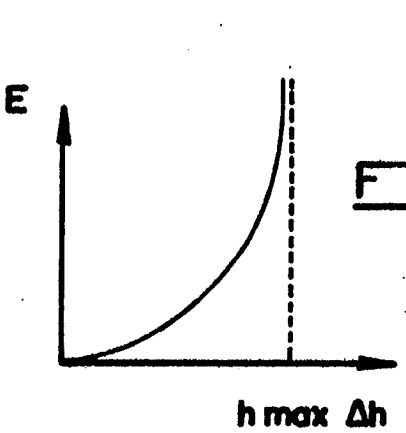
FIG. 14 illustrates the curve of FIG. 14.

FIG. 14 shows the progressive variation the curve of in accordance with the force applied at point (152) of maximum height (h max).

Naturally, other shapes for the recess can be envisioned. The various embodiments disclosed herein include recesses which are closed longitudinally at each end.

Figure 15:
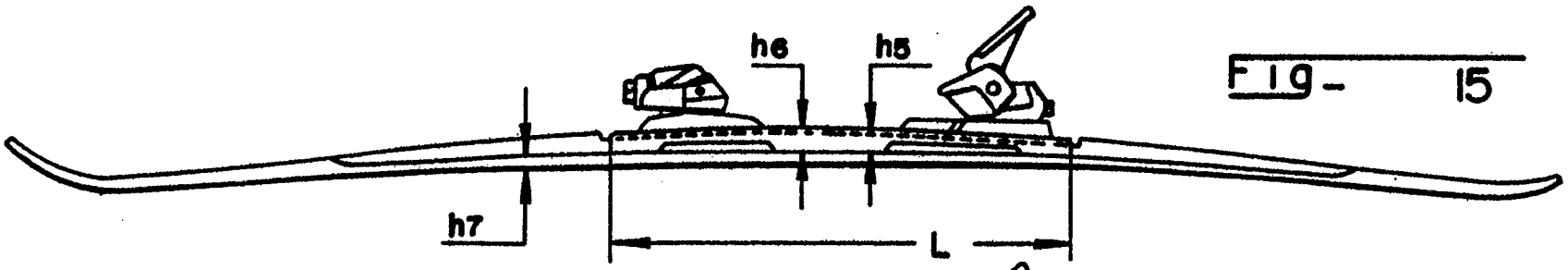
FIG. 15 is a variation of FIG. 7.

FIG. 15 shows an advantageous variation of the invention which provides an integration of the different elements constituting the ski to each other. In particular, the height ($h_5$) of the stiffener is shrunk, such height extending at least along corresponding length (L) of the support so as to form an undercut to reduce height ($h_6$) of the support and consequently the height of the bindings with respect to the snow. Similarly, height ($h_7$) of the base varies so as to enable a good integration of the support/base/stiffener elements with respect to each other.

Figure 16:
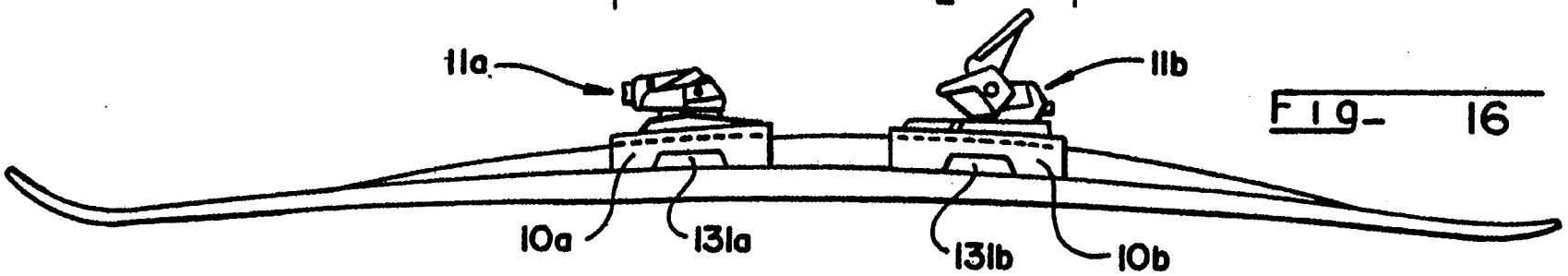
FIG. 16 is another variation.

FIG. 16 illustrates a variation in which the support is constituted by two independent semi-supports (10*a*, 10*b*) spaced from one another, a first front semi-support (10*a*) on which is fixed the front abutment (11*a*) for retention of the boot, and a second rear semi-support (10*b*) on which is fixed the heel attachment (11*b*). In this case, one can provide one or several recesses (131*a*, 131*b*) on the lateral walls of each semi-support.

The instant application is based upon French patent application No. 92.08678 of Jul. 9, 1992, the disclosure of which is hereby expressly incorporated by reference thereto, and the priority of which is hereby claimed.

The invention is not limited to the embodiments described and represented as examples, but also comprises all technical equivalents as well as combinations thereof, and other variations are also possible without leaving the scope of the invention.

What is claimed is:

1. A ski comprising:

a lower sliding surface;

two laterally opposed side portions;

two lower edges connecting the lower sliding surface and the two laterally opposed side portions;

an upper portion including:

a median rib extending longitudinally at least in a central longitudinal section of the ski; and two laterally opposed lower portions, the median rib extending upwardly from said lower portions;

a support supported by both of said two laterally opposed lower portions, said support comprising means for supporting ski bindings and having an inverted U-shape including an upper wall and two lateral walls connected to and extending downwardly from said upper wall of said support, each of said two lateral walls of said support being supported by a respective one of said two laterally opposed lower portions of said upper portion of the ski, said support defining a housing for said median rib, and at least one of said two lateral walls of said support comprising at least one longitudinally extending recess forming a slot therethrough between forward and rearward end portions of said at least one wall, said forward and rearward end portions having lower edges, at least portions of said lower edges remain in contact with said lower portions, wherein an intermediate portion of said upper wall, between said frontward and rearward end portions of said at least one wall, is capable of deflecting downwardly towards a top surface of said median rib when a downwardly directed force is placed upon said upper wall.

2. A ski according to claim 1, wherein:

the ski has an interior side and an exterior side;

said lateral walls of said support comprise an interior lateral wall on the interior side of the ski and an exterior lateral wall on the exterior side of the ski;

said at least one longitudinally extending recess comprises at least a front recess and a rear recess extending through said interior lateral wall of said support, said front recess and said rear recess being spaced apart.

3. A ski according to claim 1, wherein:

the ski has an interior side and an exterior side;

said lateral walls of said support comprise an interior lateral wall on the interior side of the ski and an exterior lateral wall on the exterior side of the ski;

said at least one longitudinally extending recess comprises at least a front recess and a rear recess extending through each of said interior and exterior lateral walls of said support, said front recess and said rear recess of each lateral wall being spaced apart.

4. A ski according to claim 1, wherein:

the ski has a predeterminate lower sliding length; and said rib has a length between 50 and 100 percent of said lower sliding length.

5. A ski according to claim 4, wherein:

the ski is comprised of a first lower assembly and a second upper assembly, said lower assembly comprising a base and said upper assembly comprising a stiffener, said stiffener comprising said median rib, said rib being affixed to said base at a front end portion and a rear end portion of said rib by respective connection means.

6. A ski according to claim 5, wherein:

said connection means at both of said front end portion and said rear end portion of said rib comprising rigid connection means.

7. A ski according to claim 5, wherein:

said connection means at both of said front end portion and said rear end portion of said rib comprising flexible connection means.

8. A ski according to claim 5, wherein:

said connection means at said front end portion and said rear end portion of said rib comprising at least one rigid connection means and at least one flexible connection means.

9. A ski according to claim 5, wherein:

said base comprises a beam comprising:

a core;

a first upper reinforcement positioned above said core;

a second lower reinforcement positioned below said core;

a sliding layer comprising two lateral metallic running edges; and a protection and decoration layer at least partially covering said upper reinforcement.

10. A ski according to claim 5, wherein:

said stiffener comprises a section comprising at least one reinforcement layer, said section having a shape that varies longitudinally for providing a longitudinally varying rigidity of said section.

11. A ski according to claim 1, wherein:

each of said lateral walls of said support comprises a lower edge;

said at least one longitudinally extending recess comprises an open undercut obtained on said lower edge of at least one of said lateral walls, said recess thereby comprising a slot having a lower surface comprised by a respective one of said lower portions of said upper ski portion.

12. A ski according to claim 1, wherein:

each of said lateral walls of said support comprises a lower edge;

said at least one longitudinally extending recess comprises a slot extending through at least one of said lateral walls, said slot being located a predeterminate distance from a respective one of said lower edges of said lateral walls.

13. A ski according to claim 1, wherein:

each of said at least one longitudinally extending recess has a longitudinal center and a predeterminate height, said height being variable in response to an applied force to said upper wall of said support; and each said recess comprises a shape for which a relationship between a perpendicular force applied to said upper wall at said longitudinal center of said recess and said height of said recess is defined as an area limited by a slope equal to 200 N/mm and a slope equal to 2000 N/mm.

14. A ski according to claim 13, wherein:

said height of each said recess is constant longitudinally.

15. A ski according to claim 13, wherein:

said height of each said recess is variable longitudinally.

16. A ski according to claim 13, wherein:

said height of each said recess is comprised between 0.5 mm and 6.0 mm.

17. A ski according to claim 13, wherein:

each said recess comprises a length between 15 mm and 150 mm.

18. A ski according to claim 16, wherein:

each said recess comprises a length between 15 mm and 150 mm.

19. A ski according to claim 17, wherein:

said length comprises between (0.02/n) L and (0.75/n) L, where n is the number of recesses and L is the length of each respective lateral of said support.

20. A ski according to claim 1, wherein:

said support is constituted by a single molded element made of plastic or composite material.

21. A ski according to claim 1, wherein:

said upper wall of said support comprises an insert embedded in said single molded element, said insert being metallic or resin-based fiber, said insert comprising means for enabling bindings to be screwed therein to affix said bindings to the ski.

22. A ski according to claim 1, wherein:

said lateral walls of said support are connected to respective ones of said two laterally opposed lower portions of the upper portion of the ski by a connection, said connection comprising a member selected from the group consisting of adhesive, screws and welding.

23. A ski according to claim 1, wherein:

said at least one recess comprises an unfilled opening extending through said one of the lateral walls.

24. A ski according to claim 1, wherein:

said at least one recess has a lateral shape of an inverted U.

25. A ski according to claim 1, wherein:

each of said two lateral walls of said support are rigidly affixed to said laterally opposed lower portions of said upper portion of the ski.

26. A ski comprising;

a lower sliding surface, two laterally opposed side portions, two lower edges connecting the lower sliding surface and the two laterally opposed side portions, and an upper portion, said upper portion of the ski including:

a rib extending longitudinally at least in a central longitudinal section of the ski; and a lowered upper surface located on opposite lateral sides of said median rib;

a support supported by said lowered upper surfaces, said support comprising an upper wall and two lateral walls connected to and extending downwardly from said upper wall, each of said two lateral walls of said support being supported by a respective one of said lowered upper surfaces said upper portion of the ski, said support defining a housing for said rib, and at least one of said two lateral walls of said support comprising at least one longitudinally extending recess, said recess having a generally inverted U-shaped, thereby forming a slot through said at least one wall between forward and rearward end portions of said at least one wall, said forward and rearward end portions having lower edges, at least portions of said lower edges remain in contact with said lower portions, wherein an intermediate portion of said upper wall, between said frontward and rearward end portions of said at least one wall, is capable of deflecting downwardly towards a top surface of said median rib when a downwardly directed force is placed upon said upper wall.

27. A ski according to claim 26, wherein:

each of said two lateral walls of said support are rigidly affixed to said lowered upper surfaces of said upper portion of the ski.

28. A ski according to claim 26, wherein:

said upper wall of said support has a length for supporting a ski boot.

29. A ski according to claim 26, wherein:

said upper wall comprises means for accepting support of a front ski binding and a rear ski binding.

* * * * *